United States Patent [19]

Monzo

[11] Patent Number: 4,969,492

[45] Date of Patent: Nov. 13, 1990

[54] METHOD AND APPARATUS FOR FILLING INFLATABLE BLADDERS

[76] Inventor: George R. Monzo, 5531 Engineer Dr., Huntington Beach, Calif. 92649

[21] Appl. No.: 413,289

[22] Filed: Sep. 25, 1989

[51] Int. Cl.[5] ..... B65B 1/04

[52] U.S. Cl. ..... 141/1; 5/451; 5/508; 116/266; 24/489

[58] Field of Search ..... 5/451, 508, 452, 455; 248/316.7; 141/1; 24/543, 499, 489, 30.5 R; 116/266, 270

*Primary Examiner*—Henry J. Recla
*Assistant Examiner*—Keith Kupferschmid
*Attorney, Agent, or Firm*—Georges A. Maxwell

[57] ABSTRACT

The method for filling a soft, flexible, thin-walled inflatable bladder with a fluid medium to a predetermined extent that comprises; folding a portion of the soft, flexible, thin-wall of the bladder and engaging the fold in predetermined pressure engagement between opposing clamping surfaces of a clamping device and thereafter introducing fluid medium into the bladder to fill it. The fold slides from engagement between the surfaces when the tensile forces directed onto and through the wall by the fluid medium delivered into the bladder exceed the holding force exerted by the clamping device.

3 Claims, 2 Drawing Sheets

M
N
10
D
F
W
H
C

T
M'
C
10
T
N
10
C
T
10
C

10
T
V
H
W
D
C

10
W
C
H
V
T

D
F

METHOD AND APPARATUS FOR FILLING INFLATABLE BLADDERS

BACKGROUND OF THE INVENTION

Throughout the arts, there is an ever increasing use of inflatable devices comprising exterior casings or bladders of thin-walled, flexible materials and that are filled with fluid mediums. The bladders or casings of a great number of those inflatable devices are made of soft, flexible and supple substantially non-elastic sheet materials that are not intended to be distended or stretched to any appreciable extent when in use.

In the case of inflatables filled with compressible gases, such as air, it is often possible to gather and/or pinch a portion of a wall of the bladders (or casings) to establish folds when the inflatables are filled to desired extents.

In the case of inflatables filled with substantially non-compressible fluid or liquid mediums, such as water, it is often possible to gather and/or pinch a portion of a wall of the bladders to establish a fold when the inflatables are filled to a desired extent where predetermined, limited slack is let to remain in the bladders.

When inflatables of the general character referred to above are inflated to a desired extent or degree, the walls of their bladders are normally subjected to predetermined tensile forces directed onto and through them by the fluid mediums that fill the bladders.

In the art of waterbeds, the most common type of waterbed includes a single or unitary watermattress structure contained within an upwardly opening frame structure. The watermattress is a bladder-like structure made of thin, flexible and supple plastic, such as sheet polyvinylfluoride. A watermattress, when in use, has or defines vertically spaced horizontal top and bottom walls and vertical side and end walls. A water filler fitting is engaged in and through the top wall, to facilitate filling (and emptying) the watermattress with water. When properly filled with water and ready for use, the watermattress is evacuated of air and is filled with a sufficient volume of water so that the top wall thereof is drawn substantially free of free-standing folds and the like yet is left with a desired amount of slack. The hardness or firmness of the watermattress is determined by the volume of water contained thereby and by the resulting slack that is left to remain in its top wall. In practice, the difference in the volume of water between a soft-filled and firm-filled standard watermattress is often little more than two or three gallons of water.

Another common and widely used type of watermattress, commonly referred to as a "tube-type watermattress" distinguishes from the above-noted common watermattress in that it is made up of an assembly of separate elongate substantially tubular water-filled bladders, or "tubes," that, when in use, are arranged in parallel, side-by-side relationship within the related bed frame structure.

In waterbeds with tube-type watermattresses, the several bladders or tubes are filled with water to an extent that they conform to the interior of their related frame structures and with each other and so that their upwardly disposed portions or top walls occur on the horizontal top planes of the mattress assemblies. That is, they are filled so that when arranged in working position the top wall of one tube does not occur on a horizontal plane that is notably higher or lower than the plane or planes on which the top walls of adjacent tubes occur.

In practice, tube-type waterbed mattresses may include as few as two and as many as twelve tubes. The difference in the volume of water in each tube to establish soft-to-firm filled watermattress assemblies is often little more than two or three cups of water, and a difference of little more than one-half to three-quarters cups of water in adjacent tubes is often sufficient to result in a notable and undesirable difference in the firmness of adjacent tubes. Accordingly, it is extremely important that the tubes in tube-type watermattresses be carefully and accurately filled so that the volume of water in each of the multiplicity of tubes is, for example, no more than one-quarter to one-half cup of water than is contained in each adjacent tube.

The task of accurately filling the tubes of tube-type watermattresses has led to the now accepted and common practice of filling the tubes, outside or remote from their related bed structures and subsequently carrying and properly placing the heavy and difficult-to-handle water-filled tubes within their related bed structures. A special art for filling those tubes has also developed. That art consists of manually elevating and holding one (designated) end of each tube of (a set of like tubes) up so that the tube is suspended vertically while it is being filled with water. Each of the several tubes is filled with water so that the vertical column of water in all of the tubes is the same. To facilitate the above filling procedure, many manufacturers of tube-type watermattresses now imprint water level lines at and along the end portions of their tubes that are to be elevated when being filled. Those water level lines include vertically spaced lines to which the water level within the vertically disposed tubes is to be brought to establish soft, medium and firm watermattress assemblies.

Since the tubes of tube-type watermattress assemblies, when filled, often contain in excess of two cubic feet of water, weight in excess of 140 pounds and are non-rigid "floppy" units prior to being placed in working position, the filling and placement of the tubes is a time-consuming and difficult procedure that, with rare exception, must be performed by large, strong and skilled professional installers, if proper installation is to be performed with reasonable dispatch and with minimum difficulties, hardships and mess.

OBJECTIVE AND FEATURES OF MY INVENTION

An object of this invention is to provide a novel method and apparatus for filling an inflatable bladder (or casing) to a predetermined extent.

Another object of the invention is to provide a novel method and apparatus for accurately filling a multiplicity of like inflatable bladders to like extent.

Yet another object of the invention is to provide a novel method and apparatus for accurately filling the multiplicity of like inflatable elongate tubular bladders of tube-type watermattress assemblies while the tubes are disposed horizontally and are arranged within their related bed structures.

It is an object and feature of the intention to provide a novel method and apparatus for accurately filling an inflatable bladder that includes manually establishing a fold in a portion of the wall of the bladder and clamping the adjacent sides of the fold between the work engaging surfaces of a clamping device, with predetermined pressure, to yieldingly hold the fold between said surfaces until the bladder is filled to tension and to cause the fold to be drawn from between said surfaces; the tension required to draw the fold from between said surfaces is that tension imparted into the wall of the bladder when it is filled to a predetermined extent by a fluid medium introduced into the bladder.

Another object and feature of my invention is to provide a new method and apparatus of the general character referred to above wherein the clamping device that is used in practicing the method can be any device with opposing work engaging surfaces between which a fold established in a portion of a wall of the bladder of the inflatable structure being filled can be slidingly functionally engaged and that functions to exert a predetermined clamping and holding force onto and through the fold.

The foregoing and other objects and features of the invention will be fully understood from the following detailed description of the invention throughout which description references made to the accompanying drawings.

DETAILED DESCRIPTION OF THE INVENTION

Though the method and apparatus for filling inflatables that I have invented can be advantageously practiced when inflating or filling many different kinds of inflatable structures having thin-walled flexible bladders or casings, it was conceived and developed to facilitate the proper and effective filling of watermattresses for waterbeds and, more particularly, for filling the several tubular bladders of tube-type watermattress assemblies. Accordingly, for the purpose of this disclosure, I have elected to and will illustrate and describe the invention as practiced when filling watermattress structures.

Figures 1, 2, 3, 4, 5:
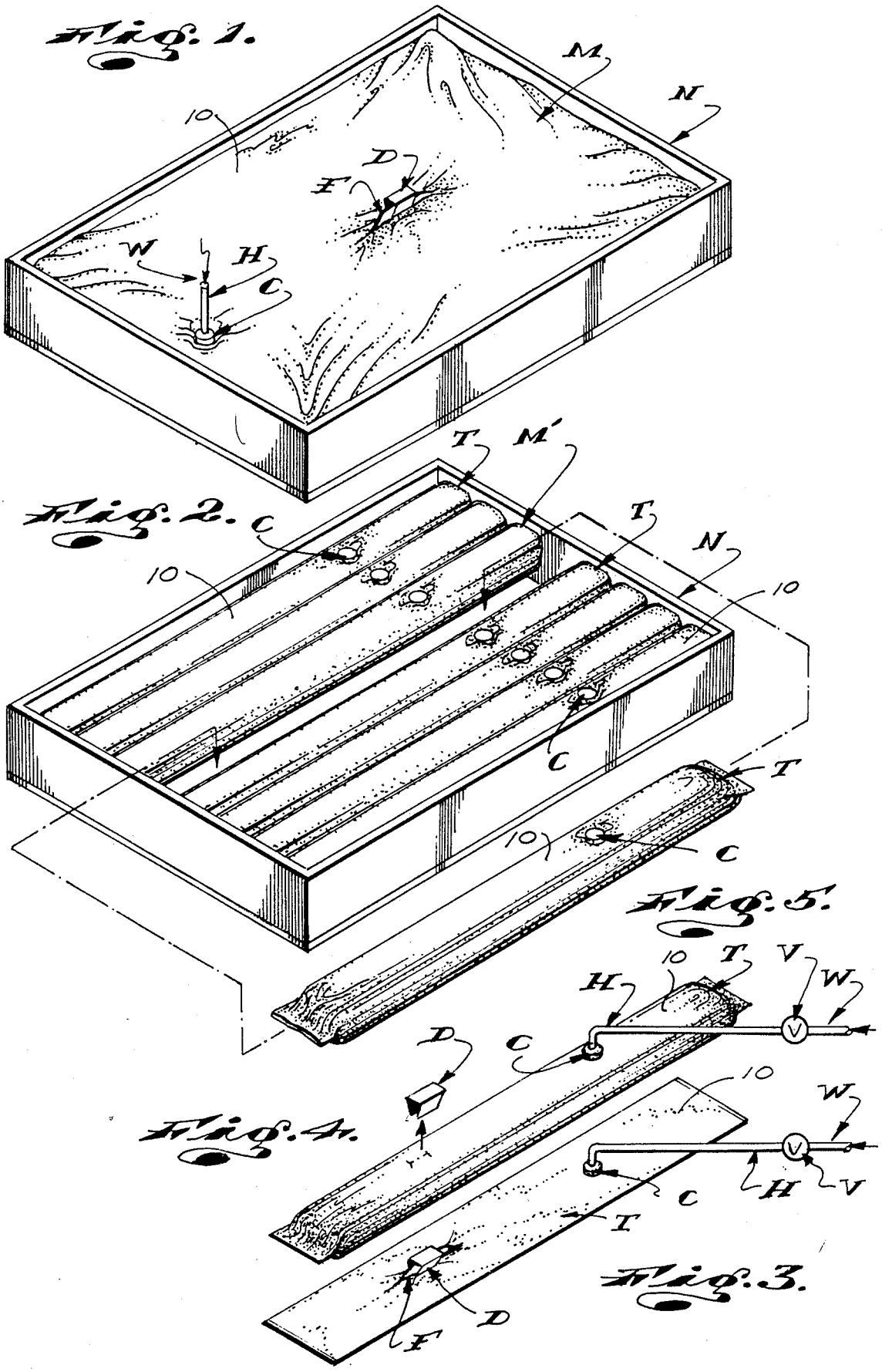
FIG. 1 is an isommetric view of a common waterbed structure with a unitary watermattress and that shows the watermattress being filled.
FIG. 2 is an isommetric view of a waterbeds assembly structure, similar to FIG. 1, with a tube-type watermattress assembly and showing one tube removed.
FIG. 3 is an isommetric view of a tubular bladder of a tube-type watermattress assembly preparatory to being filled with water in accordance with the present invention.
FIG. 4 is a view similar to FIG. 3 wherein the bladder has reached its filled condition.
FIG. 5 is an isommetric view of the filled bladder shown in FIGS. 3 and 4, preparatory to its being arranged within its related waterbed structure.

The ordinary watermattress M, such as is shown in FIG. 1 of the drawings, includes a single large bladder having an external wall formed of a suitable soft, flexible, thin-walled sheet plastic material, such as sheet polyvinylchloride. The watermattress M is arranged within and contained by an upwardly opening waterbed frame structure N. When the watermattress is properly filled with water, it occupies the interior space defined by the frame structure N and defines a substantially flat, horizontal, upwardly disposed body-supporting top wall 10.

In some watermattresses, the top wall 10 is a well defined panel-like part of the bladder structure while in other watermattresses, it is but that portion of the bladder that is disposed upwardly and defines the top wall when the watermattress or bladder is positioned within its related frame structure and is filled with water.

In accordance with common practice, the top wall 10 of the watermattress or bladder M is provided with a filler fitting C to facilitate evacuating air from within the watermattress; to facilitate filling the watermattress with water; and, to facilitate emptying the watermattress of water, when circumstances require.

In practice, when filling a watermattress with water, water is delivered into the mattress from a pressurized water or fluid medium supply means W having a manually operable on-and-off valve V, through an elongate flexible hose H is connected with and extends between the fitting C and the valve V.

In practice, the water supply means W, is an ordinary water service system, and the hose H is a common garden hose.

In practice, there are a considerable number of makes and models of filler fittings used throughout the waterbed industry, each of which is well known to those skilled in the art. With a possible few exceptions, all such fittings are two-piece molded plastic structures that include primary parts that are fixed in and through openings established in the top walls of their related watermattress bladders and with which common garden hoses can be releasably connected. In addition to the above, the fittings are provided with removable caps that are removably engaged with the primary parts of the fittings after the mattresses are filled.

Since the form and construction of the fittings C that might be encountered when practicing my invention in no way affects the novelty and/or spirit of the invention, I will not unduly burden this disclosure with further detailed illustration and description of any one particular form and construction of fitting.

In FIG. 2 of the drawings, I have shown another popular and widely used form or type of watermattress M'. The watermattress M' is a tube-type watermattress including a multiplicity or assembly of like, elongate tubular bladders T, hereinafter called tubes. When in use, the tubes T are arranged horizontally within a related frame structure N in side-by-side relationship, substantially as shown. Structurally, each tube of the assembly of tubes making the watermattress M' is essentially the same as the common watermattress structure shown in FIG. 1 of the drawings. When filled and in use, each tube of the assembly of tubes has a top wall 10 with a filler fitting C to facilitate filling the tube, as noted above.

In the case illustrated, the watermattress M' includes eight tubes. In FIG. 2 of the drawings, one of the tubes is shown removed and that tube is shown being filled in accordance with my invention, in FIG. 3, 4 and 5 of the drawings.

It is important to note that in practice the several tubes T of the watermattress M' can be and are preferably positioned within their related frame structure N when being filled and that my showing of a tube being filled outside the frame N, in FIGS. 3, 4 and 5 of the drawings, has been undertaken to more clearly illustrate and assist in describing the invention.

When the bladder of the watermattress M and/or when the tubes T of the watermattress M' are properly filled, the top walls 10 thereof are not taut and subjected appreciable tensile forces. That is, the top walls are "slack." The slack that is imparted into the top walls 10 is sufficient so that when the bodies of users of the watermattress structures are engaged atop and supported by the top walls thereof, those walls will conform to the users' bodies and will displace a sufficient extent so that the users' bodies are buoyantly supported to a desired extend by the water within the watermattress structures. The extent to which the top walls of the watermattress structures can or will be displaced downwardly, before the slack imparted therein is taken up and before the top walls are tensioned, determines the softness and/or firmness of the watermattress structures and can be adjusted, by the extent to which the bladders or tubes are filled.

In practice, the slack that is imparted into the top walls of watermattress structures is such that when the mattresses are not in use, it is possible for one to pinch and create small folds in the top walls thereof. The pinching force required to establish such folds in the top walls of watermattress structures is slight in "soft-filled" structures, wherein substantial slack is afforded and is greater in "firm-filled" structures where little slack in the top walls is afforded.

In each watermattress structure the force required to pinch and establish a fold in the top wall thereof, when it is filled, is directly related to or proportional with the "firmness" that is imparted into the structure.

The force required to pinch and establish folds in the top walls of different sizes, makes and models of watermattress structures are subject to some slight differences or variations, but as a result of the manufacturing techniques and the quality control now practiced in and throughout the waterbed industry, those forces required to pinch and establish folds in the top walls of all of the watermattress structures of any one make and model of watermattress is predeterminable and, with possible few exceptions, is only subject to minor if not imperceptible variations, from one structure to another.

Further, in the case of each of the several different types of watermattress structures that are now in common or regular use and that are made by different manufacturers, the range of forces required to pinch and establish folds in the top walls of those structures when filled and ready for use fall within a rather narrow range of forces. For example, if that range of forces for all of a particular type of watermattress structure is represented by a scale of 10, the three different forces required to pinch and establish folds in the top wall of each different make of watermattress when filled to "soft," "medium," and "firm" conditions would fall within that scale of 10.

In common, unitary watermattress structures, such as shown in FIG. 1 of the drawings, the difference in the volume of water within the structure when it is filled to soft and firm conditions is often little more than two or three gallons of water while in the tube-type watermattress assemblies such as shown in FIG. 2 of the drawings, the difference in the volumes of water within the several tubes, when the whole of the assembly of tubes is filled to soft and firm conditions is often little more than two cups of water. Accordingly, the latitude in the volume of water that is used to fill a common, unitary watermattress is not great and the exercise of a notable degree of skill, care and attention is required to properly fill such a mattress to a soft, medium or firm condition.

In the case of tube-type watermattress structures, far less latitude in the volume of water that is used to fill the several tubes exists and the exercise of great skill, special care and attention are required to properly fill the several tubes to like extent and to thereby establish a soft, medium or firm watermattress assembly. In addition to the foregoing, in the case of tube-type watermattress structures special care must be exercised so that all of the tubes are filled to the same or similar extent so that no perceptible differences exist between adjacent tubes when they are filled and the watermattress is ready for use. No perceptible differences in firmness should be left to exist between adjacent tubes and no perceptible difference in the vertical planes of the top walls of adjacent tubes should be left to exist, since either or both of those conditions are likely to notably adversely affect the effectiveness and comfort that is intended to be afforded by the watermattress. In practice, if the difference in the volume of water filling adjacent tubes is but one cup of water, a perceptible difference in both the flatness or evenness and the firmness of the whole of the watermattress structure is likely to exist and the resulting watermattress assembly is likely to be rendered so maladjusted as to be unsuitable for regular use.

The new method of filling inflatables that I provide enables persons filling their watermattress bladder structures to fill those structures to predetermined desired firmness without that special skill and care that is required to be exercised when filling those structures in accordance with old and common practices.

My new method includes: first, pinching a fold in a small portion of the top wall of the watermattress structure to be filled; second, clamping the adjacent and opposing layers of the fold together with that pressure that will hold the fold set until the structure is filled to a predetermined extent; third, introducing water into the structure (through a filler fitting thereof) until the clamping forces on the fold are overcome and the fold in the top wall is drawn to unfold; and, fourth, stopping the flow of water into the structure.

The apparatus that I provide includes a clamping device with spaces jaws defining opposing work engaging surfaces between which the fold established in the top wall of the mattress structure is engaged, that exert predetermined clamping force onto and across the fold and from between which the fold is drawn when the structure is filled with water to a predetermined extent.

Figure 9:
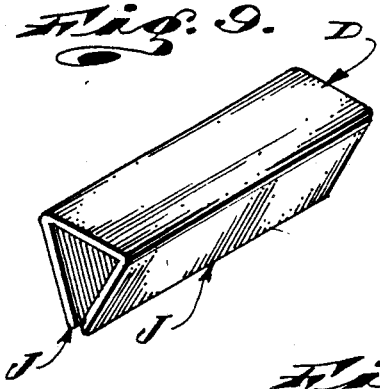
FIG. 9 is an isommetric view of one form of clamping device.

In FIG. 9 of the drawings, I have shown one simple and effective clamping device D suitable for use in carrying out my invention. The device D is an elongate resilient C-clamp unit within which a fold in the top wall of a related watermattress can be freely accommodated and that has a pair of elongate, parallel, jaws J, with work engaging surfaces, that establish predetermined yielding pressure engagement on their related sides of the fold and/or predetermined holding and clamping pressure on and through the fold.

In one satisfactory and effective reduction to practice of my invention the clamping device was similar to the device D shown in FIG. 9 of the drawings. It was established by a one-inch long piece of an elongate extruded plastic manuscript binding spline such as is commonly used to clamp and bind together the left-hand marginal edges of the several pages of manuscripts together. Such manuscript binding splines are most commonly provided in 11-inch long strips and are no more than elongate resilient C-clamp type or paper clips. The above noted clamping device was used repeatedly when filling the multiplicity of tubes of a tube-type watermattress structure in accordance with my new method. The volumes of water in the tubes of the watermattress structure thus filled were measured and a difference of no more than four ounces of water was found to exist in the volumes of water in adjacent tubes.

Further, while experimenting and testing my invention single tubes of tube-type watermattress were repeatedly filled in accordance with my new method, utilizing the above-noted device and the volumes of water filling the tubes, each time they were filled, seldom varied more than two ounces.

Figure 6:
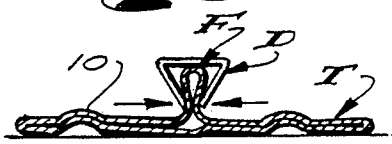
FIG. 6 is a cross-sectional view of an inflatable bladder with a clamping device clamping a fold therein, preparatory to filling the bladder.

In FIG. 6 of the drawings, I have shown the device D engaged with a fold F in the top wall 10 of a deflated bladder or tube T in accordance with my new method; and, preparatory to filling the tube. Note that the fold F is fully and freely engaged within the device D.

Figure 7:
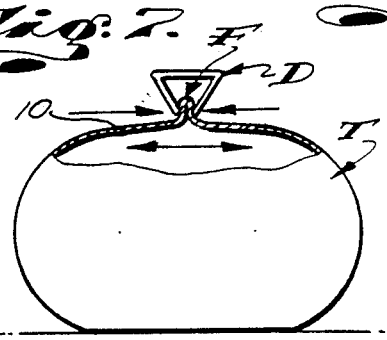
FIG. 7 is a view of the structure shown in FIG. 6, partially filled.

FIG. 7 of the drawings shows the tube T partially filled with water. Note that the fold F has started to draw itself from within the device D.

Figure 8:
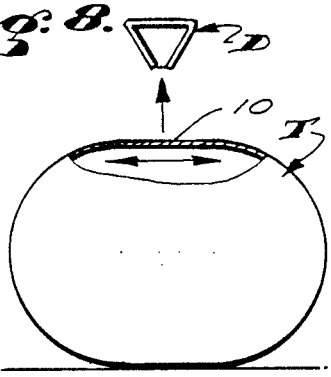
FIG. 8 is a view showing the structure in FIGS. 6 and 7, filled and showing the clamping device disengaged therefrom.

In FIG. 8 of the drawings, the tube T is shown filled with water, the device D has been disengaged from the tube and the top wall 10 of the tube has unfolded.

In practice, when the device D disengages the tube T it has been observed to "pop" free from the tube and to be driven or propelled by the unfolding tube a substantial distance. When disengaged from the tube in the manner set forth above, the jaws of the device D close and contact each other sharply and with sufficient force to make an audible "pop" or "click" sound which is sufficient to signal one attending to the filling of the tube that the tube is filled.

It is to be noted that the wall thickness of the plastic sheeting of which different watermattress structures are made is from 5 mils to 10 mils thick. Further, in my above noted reduction to practice of my invention, the major cross-sectional dimension of the clamping device D was about ⅜-inch and the mean cross-sectional dimension of the tubes T (when filled) was about eight inches. Accordingly, the proportioning of the parts shown in the drawings is not correct and has been greatly exaggerated for the purpose of disclosing the invention.

While experimenting and testing my new method, I have used several different kinds of available clamping devices, each of which applied a different clamping force onto folds established in the walls of the watermattress structures with which it was related. Those experiments and tests clearly established that the application of different forces on the folds in the mattress structures, when practicing my new method, result in filling of the mattress structures to different firmnesses. The differences in the firmness of the mattress structures filled in accordance with my new method was substantially proportional to the forces applied by the clamping devices to the folds made in the mattress structures.

In accordance with the above and in furtherance of my invention, it is contemplated that a set of three or more clamping devices D, such as shown in FIG. 9 of the drawings, each having a different, predetermined and appropriate clamping force can be provided to enable one practicing my new method to accurately fill a watermattress structure worked upon to, for example, soft, medium or firm extent, as desired or as circumstances require. The force exerted by those devices can, for example, be determined by the wall thickness of the parts, the size and/or dimensions of the parts, changes in the materials of which the parts are made, tempering of the parts and the like. In practice, the several parts or clamps of each set of clamps can be; color-coded; labeled "soft," "medium" and "hard"; consecutively numbered 1, 2 and 3; or can otherwise be identified and distinguished, one from the other, for easy and effective use thereof.

Figure 10:
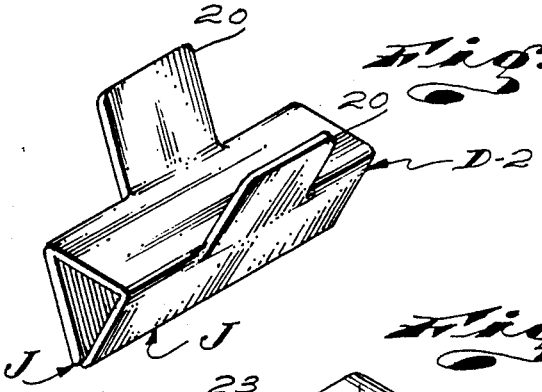
FIG. 10 is an isommetric view of a modified form of the device shown in FIG. 9.

In FIG. 10 of the drawings, I have shown another form of clamping device D-2 similar to the device D but which includes finger tabs 20 for enabling the user of the device to forcibly open the device to facilitate engaging it with a fold in a related watermattress structure.

It will be noted that the clamping device D-2 is similar in design with common metal C-clamp paper clips and is functionally indistinguishable therefrom. Accordingly, it will be apparent that such common paper clips might be advantageously used in practicing my new method.

Figure 11:
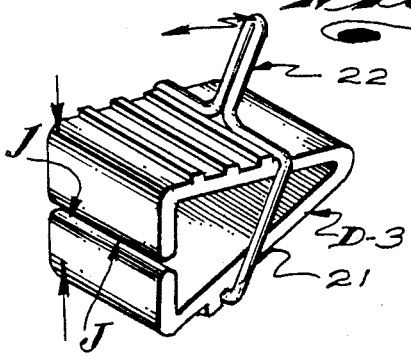
FIG. 11 is an isommetric view of another form of clamping device.

In FIG. 11 of the drawings, I have shown another form of clamping device D-3 that includes a resilient C-shaped body 21, that might be extruded or molded of a suitable plastic, and a metal wire yoke 22 pivotally carried by one leg or arm of the body and shiftable to several different positions on and with another leg or arm of the body to alter or change the force that is exerted by the jaws J of the device onto the fold of a related watermattress structure. The different forces exerted by the device D-3 when the yoke 22 is in different positions are effective to result in filling a related watermattress structure to different, predetermined firmnesses, when the device is used to fill a mattress structure in accordance with my invention.

Figure 12:
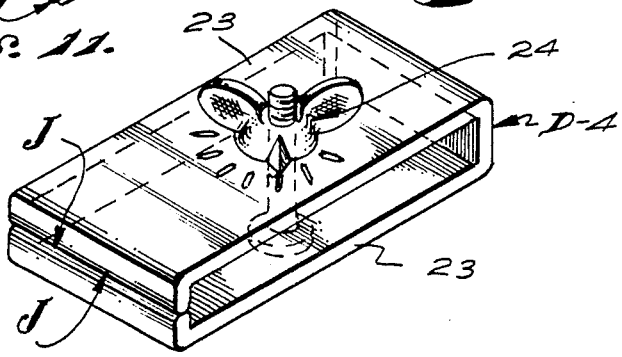
FIG. 12 is an isommetric view of yet another form of clamping device.

In FIG. 12 of the drawings, I have illustrated another form of clamping device D-4 that includes a C-shaped body 23 and a manually operable nut-and-bolt assembly 24 engaged with and between the arms or legs of the body 23 the assembly 24 is operable to adjust the force that is applied by the jaws J of the device D-4 onto a fold of a related watermattress structure when that structure is being filled in accordance with the teachings of my invention.

Figure 13:
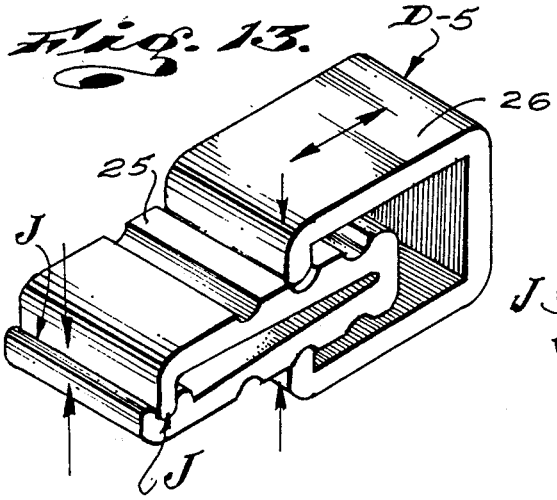
FIG. 13 is an isommetric view of still another form of clamping device; and, FIG. 14 is an isommetric view of another form of clamping device.

FIG. 13 is a view of yet another form of clamping device D-5 including two interengaged C-shaped parts 25 and 26. The forward part 25 has jaws J to engage a fold in a related watermattress structure and the other or rear part 26 is engaged with and about the part 25, as shown. The clamping force afforded by the part 26 supplements the clamping force afforded by the part 25. By shifting the position of the part 26 forwardly or rearwardly relative to the part 25, the clamping force afforded by the part 25 can be adjusted as desired or as circumstances require.

Figure 14:
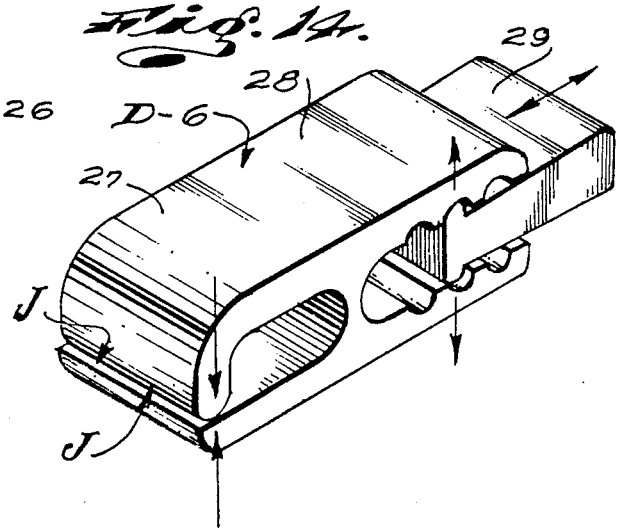

In FIG. 14 of the drawings, I have shown yet another form of clamping device D-6. This device comprises a resilient C-clamp type body 27 with a pair of lever arms 28 between which a wedge 29 is shiftably engaged to vary the clamping force afforded by the device at the jaws J thereof.

It will be apparent that the adjustable clamping devices shown in FIGS. 11 through 14 of the drawings are such that each can be adjusted to fill waterbed structures with which those devices might be related to different predetermined degrees of firmness, when used while carrying out my new method.

I have tested and determined that the common type of clothespin comprising a pair of elongate clamp parts yielding pivotally coupled together by a rat-trap spring would be effective clamping devices for use in carrying out my invention, if made to exert appropriate clamping forces.

The several different forms of clamping devices that I have shown and briefly described above are presented for the purpose of showing that practicing my new method is not dependent upon the use of any one or particular form of clamping device and to show several different basic kinds of clamping devices that might be advantageously used.

In the waterbed art, there are those installers who can, by pinching the top wall of a watermattress to determine with reasonable accuracy if a watermattress is softly or firmly filled according to commonly accepted standards. Accordingly, it is possible that one with appropriate skill might practice my new method by clamping a fold in a watermattress between his or her fingers and attain satisfactory results.

In FIG. 1 of the drawings, I have shown the device D engaged with a fold F in the top wall 10 of the mattress M. The device D is made to exert a predetermined force on the fold F. Depending upon the clamping force of the device D on the fold F, V-clamp will remain engaged with and across the fold F until the watermattress M is filled to that extent which is determined by the device D whereupon the fold is from engagement with the device D. That is, when the mattress M is filled to that extent that no excess slack is left to remain in the top wall 10 of the mattress structure, as determined by the firmness that is to be imposed into the watermattress structure, the fold F is drawn from engagement with the device.

When developing and testing my invention, my primary interest and concern was directed to the filling of watermattress structures. A secondary interest was in the inflating of air-filled mattresses. Accordingly, I have tested the use of my new method and apparatus by filling water mattress structures with air rather than with water and determined that the method and apparatus was highly effective and dependable to effect uniform, predetermined filling such inflatable structures with air up to pressures of 5 psi at least. Though the foregoing tests were limited as to pressure, they clearly established that my new method is effective to inflate low pressure inflatables with soft flexible substantially non-elastic bladders or casings with air and that its use is not limited to watermattresses and the like.

Having described my new method and apparatus, I do not wish to be limited to the specific details herein set forth but wish to reserve to myself any modifications and/or variations that might appear to those skilled in the art and which fall within the scope of the following claims.

Having described my invention, I claim:

1. A method for filling an inflatable structure using a clamping device wherein, the inflatable structure has an external wall with interior and exterior surfaces and made of thin, substantially non-elastic, flexible sheet material, a filler fitting in the wall; and, a fluid medium supply means releasably connected with the fitting and operating to selectively start and stop the conducting of a fluid medium into the structure; and, the clamping device has a pair of relatively movable jaws with work engaging surfaces that exert predetermined clamping and holding force onto work engaged therebetween; the method includes; first, gathering an outwardly projecting fold in said wall formed by two adjacent layers of said material with opposing interior surfaces and opposite, disposed exterior surfaces; second, arranging the fold between the jaws of the clamping device with the work engaging surfaces of the jaws in clamping holding engagement with the exterior surfaces of the fold; third, starting the conducting of the fluid medium into the inflatable structure and filling the inflatable structure until the forces directed onto the wall by the fluid medium draw the fold from engagement between the work engaging surfaces of the jaws which unfolds the wall; and, fourth, immediately after the fold is drawn from the work engaging surfaces of the stopping the conducting of the fluid medium into the structure.

2. The method set forth in claim 1 wherein the clamping device includes a pair of relatively movable arms connected to the jaws and between which the fold is accommodated.

3. The method set forth in claim 1 that includes a plurality of clamping devices selectively engageable with a fold established in the wall of the inflatable structure, each of the devices exerts a different predetermined clamping and holding force, the force exerted by each device is such that the fold in the wall of the structure is drawn from engagement with the device and unfolds when the inflatable structure is inflated to a predetermined firmness.

* * * * *